United States Patent [19]

Brovman et al.

[11] 4,250,949

[45] Feb. 17, 1981

[54] SEMICONTINUOUS CASTING APPARATUS

[76] Inventors: Mikhail Y. Brovman, ulitsa N. Kurchenko, 12, kv. 22; Ivan K. Marchenko, ulitsa Lenina, 6, kv. 94; Nikolai M. Kozy, ulitsa Shkadinova 72a, kv. 58, all of Kramatorsk; Viktor A. Efimov, ulitsa Vladimirskaya 51/53, kv. 88; Richard Y. Yakobshe, ulitsa Kablukova 11, kv. 36, both of Kiev, all of U.S.S.R.

[21] Appl. No.: 19,746

[22] Filed: Mar. 12, 1979

[51] Int. Cl.[3] ..... B22D 11/08; B22D 11/128

[52] U.S. Cl. ..... 164/425; 187/1 R; 164/441

[58] Field of Search ..... 164/425, 426, 445, 446, 164/441; 187/1 R

[56] References Cited

U.S. PATENT DOCUMENTS

| | | | |
|---|---|---|---|
| 3,667,534 | 6/1972 | Kanokogi et al. | 164/426 X |
| 3,841,441 | 10/1974 | Klinkhammer et al. | 187/1 R |

*Primary Examiner*—Robert D. Baldwin

*Attorney, Agent, or Firm*—Lackenbach, Lilling & Siegel

[57] ABSTRACT

A semicontinuous casting apparatus comprises a mould positioned above a secondary-cooling chamber which accommodates a dummy bar having a thickened portion and a body made in the form of a hydraulic cylinder intended to pull out a casting and mounted to move lengthwise of said chamber. For the dummy bar to be able to move, the apparatus is provided with alternately actuated index pins. The pins are fixed on stationary mounted legs and extend through openings in the walls of the secondary cooling chamber and cooperate with openings provided in the lateral sides of the thickened portion and body of the dummy bar.

1 Claim, 3 Drawing Figures

SEMICONTINUOUS CASTING APPARATUS

BACKGROUND OF THE INVENTION

1. Field of the Application

The present invention relates to ferrous and non-ferrous metallurgy and, more particularly, to the practice of semicontinuous casting of metal.

This present invention will find application in casting large-size sections which undergo further forging and rolling operations, as well as for manufacturing consumable electrodes for use in electroslag remelting and vacuum arc melting processes.

To meet an ever growing demand of metallurgical and machine-building industries in large-size cast sections, the production of the large size cast sections should be drastically increased. The castings of this type are required in great number for blooming and slabbing mills, as well as in forgery shops. When cast in iron moulds, the ingots for roughing mills are cut off with the resultant 11 to 16 percent of metal being lost in the zone of shrinkage cavity.

Large-size ingots (400 to 1300 mm in cross-sectional diameter) are needed for use in electroslag remelting and vacuum arc melting processes. These modern processes for the production of metal workpieces open the way for improvement of metal quality. Therefore, it is of particular importance that the electroslag and vacuum arc melting installations should be provided with consumable electrodes of large cross section.

2. Description of the Prior Art

A number of installations have been recently built to carry out semicontinuous casting of consumable electrodes. It has been found in the course of their operation that the gain in yield was up from 6 to 9 percent, and the quality of ingots produced by either electroslag or vacuum arc melting process was improved. In modern practice of casting large-size consumable electrodes, use is made of elongated build-up iron moulds. However, due to the splashing of molten metal poured from a height of 6 to 8 meters, the surface quality of consumable electrodes is impaired and the amount of metal lost during pouring is increased. It is therefore obvious that this process of casting consumable electrodes needs drastic improvement.

It should also be observed that the bottom casting of metal in elongated iron moulds is ineffective, since the metal undergoes undercooling in the meniscus area, thereby causing metal defects or flaws.

The now-in-use technological process for casting large-size ingots to be worked in forging shops is likewise far from being perfect. During this process the ingots are cast in iron moulds. The gain in yield amounts to only 65 to 70 percent. Needless to say that the casing process during which there is wasted from 30 to 35 percent of the metal is quiet unsatisfactory.

As to continuous-casting machines, these are suitable only for the production of ingots having cross-sectional dimensions of up to 400×400 mm. Any further increase in the cross-sectional size of ingots necessitates casting machines of appreciably larger working heights, which, in turn, renders them more complicated in construction and increases capital cost for their installation.

Therefore, attempts have been taken to develop a machine for semicontinuous casting of metal, suitable for the production of large-size ingots.

For example, there is known a semicontinuous-casting machine disclosed in USSR Inventor's Certificate No. 325,088, which comprises a mould and a dummy bar positioned on a platform movable along guides with the aid of a rope drive mechanism intended to effect the casting withdrawal operation.

However, the machine of the Inventor's Certificate referred to above is very large in height, which is because of the fact that the pulley system is provided in the mould area . In addition, by reason of insufficient rigidity of the casting withdrawal mechanism, the casting of large mass is not moved smoothly but in jerks. This, in turn, adversely affects the casting quality, results in nonheterogenous properties of the casting metal, causes crackings and other flaws to appear in the casting, and causes excessive dynamic loads acting on the casting machine as a whole.

The disposition of the pulley system and rope in the zone of elevated temperatures reduces their service life and impairs operating reliability of the semicontinuous-casting machine.

There is also known a semicontinuous-casting machine described in the book "Continuous Casting of Steel" by M. C. Boichenko et al., USSR, Moscow, Metallurgizdat Publishers, 1961, p. 31, which comprises a mould and a dummy bar positioned on a movable platform sliding along guides with the aid of the casting withdrawal screw drive mechanism.

The casting machine mentioned above also has a considerable working height, which is dictated by the necessity to arrange the casting withdrawal drive mechanism below the mould (the drive being in top position), or below the movable platform (the drive being in bottom position).

Difficulties also arise when it comes to the production of long-size castings, requiring the provision of rather lengthy screws for the casting withdrawal mechanism, which are manufactured in a limited number. Furthermore, the arrangement of the screws of the casting withdrawal drive mechanism in close proximity to the casting, i.e. in the zone of elevated temperatures, increases the rate of wear of these screws, reduces their service life and impairs operating reliability of the casting machine as a whole.

USSR Inventor's Certificate No. 537,751 describes a machine for semicontinuous casting of metal, which comprises a mould and a dummy bar positioned on a movable platform sliding along guides with the aid of the rack-and-gear drive casting withdrawal mechanism. The casting withdrawal mechanism includes stationary mounted racks and gear wheels arranged on a movable platform and driven from an electro-mechanical actuator also positioned on the movable platform.

The casting machine of the Inventor's Certificate referred to above also suffers from a number of serious disadvantages, namely: it is complicated in construction, the platform-mounted casting withdrawal drive mechanism being cumbersome; the bulky structure of the casting withdrawal drive mechanism restricts the production of massive castings; and the height of the casting machine is enormous, which is due to the location of the casting withdrawal drive mechanism on the movable platform.

There is also known another semicontinuous-casting machine described in the book "Continuous Casting" by Erhard Germann, USSR, Metallurgizdat Publishers, Moscow, 1961, p. 419, FIG. 1290, which comprises a mould arranged above a secondary-cooling chamber and a dummy bar made up of a lower fixed section and an upper movable section. The lower fixed section of the dummy bar is made in the form of hydraulic cylinder with the piston rod thereof interacting with the upper section of the dummy bar.

The casting machine in question is simple in construction and has sufficient rigidity permitting the production of massive castings of large cross section.

However, this casting machine suffers from a disadvantage, it being its considerable working height which includes the length of the mould, the length of the casting and the length of the lower fixed section of the dummy bar, i.e. the length of the hydraulic cylinder body which is larger in length than the casting, since the cylinder functions, on the one hand, to introduce the upper section of the dummy bar into the mould cavity and, on the other hand, to ensure the formation of the casting of a prescribed length, as well as its complete withdrawal from the mould. It should be observed that the dummy bar upper section is moved from the uppermost position to the lowermost position in one piston stroke of the hydraulic cylinder.

The enormous height of the casting machine renders its installation difficult in modern shops of metallurgical and machine-building plants. If its installation is effected in newly built shops, the height of the shops should be considerably increased, thus resulting in a higher capital cost for the installation of both the shop and the casting machine.

SUMMARY OF THE INVENTION

It is the principal object of the invention to provide a semicontinuous-casting apparatus which will have a height substantially smaller than that of the prior-art apparatus of similar type.

Another important object of the invention is to provide a semicontinuous casting machine, the installation of which will be more economic than that of the prior-art casting machines of similar type.

These objects and features of the invention are accomplished by a semicontinuous-casting apparatus comprising a mould positioned above a secondary-cooling chamber arranged intermediate stationary mounted legs and accommodating a dummy bar having a thickened portion and a body made in the form of a hydraulic cylinder intended to withdraw a casting and mounted to move along the secondary-cooling chamber. Also provided are index pins longitudinally movable by means of actuators secured to stationary mounted legs, said pins extending through openings in the walls of the secondary-cooling chamber and cooperating with openings fitted in the lateral sides of the dummy bar thickened portion and body.

Such compact structural arrangement of the dummy bar and its actuator makes it possible to reduce a semicontinuous casting machine in height and to reduce the expenses required for its installation.

The hydraulic cylinder effecting the withdrawal of a casting is preferably provided with an additional chamber arranged in series and accommodating a second rod of a piston whose stroke is two times less than that of the piston stroke of the hydraulic cylinder effecting the casting withdrawal.

This permits the apparatus production efficiency to be enhanced to a level in conformity with modern requirements.

BRIEF DESCRIPTION OF THE DRAWINGS

The invention will be further described, by way of example only, with reference to the accompanying drawings, in which.

DETAILED DESCRIPTION OF THE PREFERRED EMBODIMENTS

Figure 1:
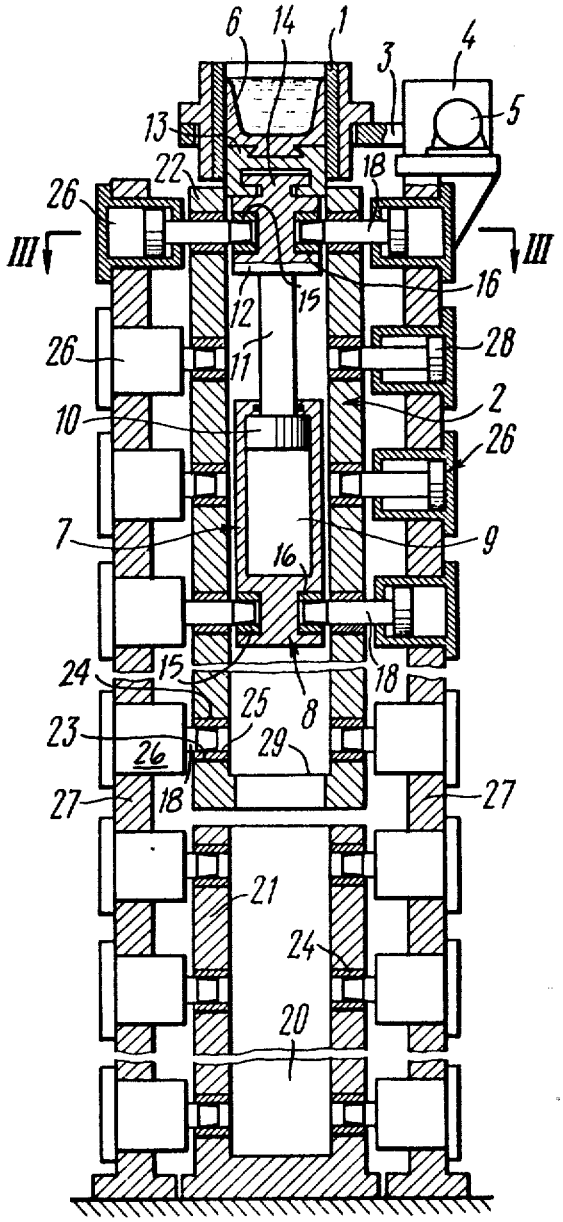
FIG. 1 is a partial longitudinal cross-sectional view, with break-outs and tear-outs, of a semicontinuous-casting apparatus comprising a dummy bar with only one chamber adapted to accommodate a piston therein.
Figure 3:
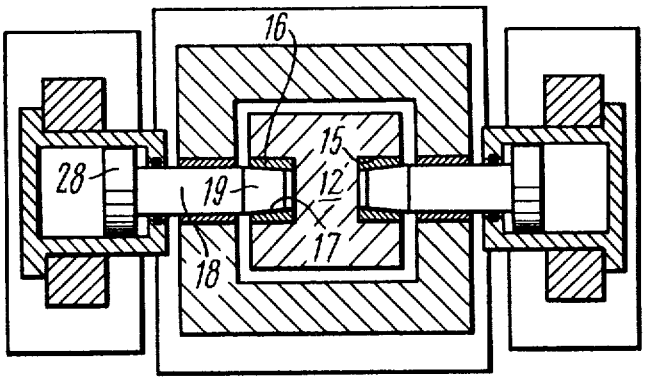
FIG. 3 is an enlarged cross-sectional view taken along line III—III of FIG. 1.

Referring now to the drawings in detail, and to FIG. 1 in particular, there is shown therein a semicontinuous-casting apparatus which comprises a mold 1 mounted above a secondary-cooling chamber 2 on a frame 3 of a device 4 intended for oscillating the mould 1 and movable by means of an actuator 5. A casting 6 is withdrawn from the mould 1 by means of a dummy bar 7 which includes a body made in the form of hydraulic cylinder 8 adapted to effect the casting withdrawal operation and having a chamber 9 which accommodates a piston 10 in rigid connection with a rod 11 formed with a thickened portion 12 of the dummy bar 7, which is connected to a detachable section 13 by means of a catch 14. Provided on the lateral sides of the thickened portion 12 and in the thickened bottom of the hydraulic cylinder 8 are openings 15 (FIG. 3) adapted to receive sleeves 16 formed with conical holes 17. Cooperating with the thickened portion 12 (FIG. 1) and with the hydraulic cylinder 8 functioning to withdraw the casting 6 are index pins 18 introduced into the holes 17. To facilitate the introduction of the index pins 18 into the holes 17, the holes 17 are made conical and the index pins 18 are formed with tapered portions 19 which conform to the shape of the holes 17 (FIG. 3). Disposed below the secondary-cooling chamber 2 (FIG. 1) is a shaft 20 formed with walls 21 and adapted to receive and store therein the dummy bar 7. Fitted in the walls 22 of the secondary-cooling chamber 2 and in the walls 21 of the shaft 20 are through holes 23 spaced from one another at a distance equal to the stroke of the piston 10 of the hydraulic cylinder 8 intended to pull out the casting 6, said holes receiving therein sleeves 24 formed with through holes 25. Received in the through holes 25 are index pins 18 longitudinaly movable by means of actuators made in the form of hydraulic cylinders 26 secured to legs 27. The pistons 28 of the hydraulic cylinders 26 are connected with the index pins 18 which also function as rods of the hydraulic cylinders 26.

When in the lowermost position, the casting 6 bears through the dummy bar detachable section 13 against a projection 29.

To ensure easy entry of the index pins 18 into the holes 17 (FIG. 3), the dummy bar 7 (FIG. 1) is formed so that a minimum and a maximum distance between the holes (FIG. 3) in the thickened portion 12 and in the body of the hydraulic cylinder 8 are multiples of the length of a working stroke of the index pins 18.

The sleeves 16 accommodated in the thickened portion 12 of the dummy bar 7 and of the hydraulic cylinder 8 and the sleeves 24 in the walls 22 and 21 are provided to protect the surfaces of these walls from wearing which occurs in the course of interaction with the index pins 18, said sleeves being made detachable.

According to another embodiment of the dummy bar 7, the detachable section 13 thereof is connected with the body of the hydraulic cylinder 8 intended for pulling out the casting 6, the thickened portion 12 of said dummy bar (FIG. 2) being positioned below. The first herein described embodiment (FIG. 1), however, is preferable due to a more simple system of working fluid supply to the hydraulic cylinder 8, which fluid is not heated by the casting.

The apparatus according to the invention for semicontinuous casting of metal operates in the following manner.

Prior to the casting operation, the detachable section 13 (FIG. 1) of the dummy bar 7 is introduced into the mould 1 by means of the hydraulic cylinder 8. In their original position, prior to casting operation, the index pins 18 are found in the holes 17 (FIG. 3) fitted in the thickened portion 12 of the hydraulic cylinders 8 forming the dummy bar 7, the piston 10 of the hydraulic cylinder 8 being in its uppermost position relative to the body of the hydraulic cylinder 8.

A molten metal is poured into the cavity of the mould 1 until it reaches a preset level, whereupon the index pins 18 are actuated by the hydraulic cylinders 26 and withdrawn from the holes 17 (FIG. 3) in the thickened portion 12 (FIG. 1) of the dummy bar 7, with the working fluid pressure being built up above the piston 10. The casting 6 is moved at a preset speed for a distance equal to that of the stroke effected by the piston 10.

As the withdrawal of the casting 6 commences, the mould oscillating device 4 is concurrently actuated to transmit swinging, i.e. reciprocated motion to the mould 1 lengthwise of the casting through the actuator 5 and the frame 3.

After the piston 10 is moved to the lowermost position relative to the body of the hydraulic cylinder 8, the index pins 18 are introduced into the holes 17 (FIG. 3) in the thickened portion 12, whereupon the index pins 18 are brought out of the holes 17 provided in the body of the hydraulic cylinder 8. Thereafter, the working fluid pressure is built up below the piston 10 whereby the body of the hydraulic cylinder 8 is moved downwardly to take the lowermost position relative to the piston 10, whereupon the index pins 18 are again introduced into the holes 17 in the hydraulic cylinders 8. The index pins 18 are then withdrawn from the holes 17 provided in the thickened portion 12, with the working fluid pressure being built up above the piston 10 to thereby enable the casting withdrawal for a distance equal to that of the stroke of the piston 10. The operating cycle of the semicontinuous casting apparatus of the invention is then resumed.

In this manner the casting withdrawal operation of the semicontinuous-casting apparatus of the invention is effected.

After the casting operation is completed, the casting 6 is positioned on the projection 29 by means of the dummy bar detachable section 13. The casting can be removed from the apparatus in two possible ways.

According to one embodiment of the invention, the solidified casting is brought upwardly out under the action of the dummy bar 7 during its backward movement. Prior to this operation, the mould 1 is brought aside.

According to another embodiment of the invention, the index pins 18 are formed so as to be capable of withdrawal to outside the walls 22 of the secondary-cooling chamber 2. After the solidified casting 6 is positioned on the projection 29, the detachable section 13 is separated from the thickened portion 12, and the index pins 18 are withdrawn outside the secondary-cooling chamber 2, with said chamber being brought outside the apparatus together with the casting and detachable section 13. The changeable secondary-cooling chamber 2 is then mounted, the dummy bar 7 is moved upwards, the interchangeable detachable section 13 is mounted on the thickened portion 12, and the dummy bar 7 is introduced into the mould 1, whereby the casting cycle is resumed. According to this embodiment of the invention, the dummy bar 7 is arranged in the shaft 20 at the end of the casting cycle.

Figure 2:
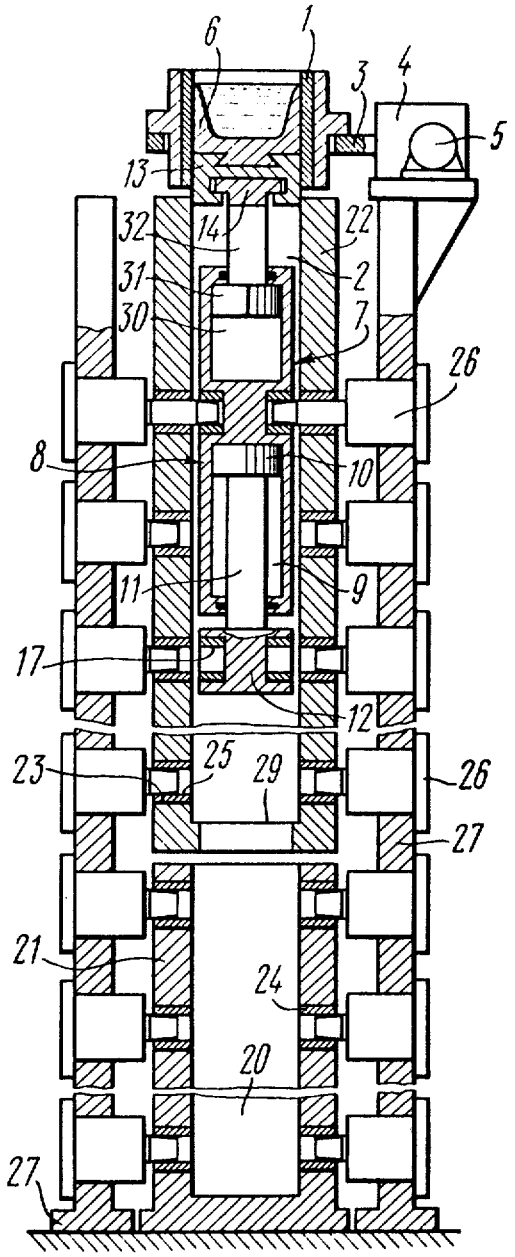
FIG. 2 is a partial longitudinal cross-sectional view, with break-outs and tear-outs, of a semicontinuous-casting apparatus comprising a dummy bar with two chambers adapted to accommodate pistons therein.

The embodiment of the invention shown in FIG. 2 comprises all the structural elements included in the embodiment of the invention shown in FIG. 1, the former being distinct from the latter only in that the hydraulic cylinder 8 intended for the withdrawal of the casting is formed with an additional chamber 30 adapted to accommodate the piston 31 in rigid assembly with the rod 32, the length of the additional chamber 30 being such that the stroke of the piston 31 is two times less than the stroke of the piston 10 of the hydraulic cylinder 8. The rod 32 is connected by means of the catch 14 with the detachable section 13 of the dummy bar 7.

In the embodiment of the invention shown in FIG. 2 the thickened portion 12 of the dummy bar 7 is positioned below, and the hydraulic cylinder 8 is disposed above.

The semicontinuous-casting apparatus according to the second embodiment of the invention shown in FIG. 2 operates as follows. Prior to casting the detachable section 13 of the dummy bar 7 is introduced into the cavity of the mould 1, by means of the hydraulic cylinder 8. Before casting is commenced, the index pins 18, in their starting position, are found in the holes 17 provided in the hydraulic cylinder 8 of the dummy bar 7, and the pistons 10 and 31 of the hydraulic cylinder 8 are found in the uppermost positions relative to the body of the hydraulic cylinder 8.

A molten metal is poured into the cavity of the mould 1 to a pr,eset level, whereupon the working fluid pressure is built up above the pistons 10 and 31, the flow rate of the working fluid being selected such that the piston 31 is enabled to move at a speed equal to that of the casting withdrawal, and the piston 10 is enabled to move at a speed of 2.2 to 2.5 times the speed of the casting withdrawal. The casting is moved for a distance equal to the length of the stroke of the piston 31. Since the length of the stroke of the piston 10 is two times that of the stroke of the piston 31, and the travelling speed of the piston 10 is 2.2 to 2.5 times the travelling speed of the piston 31, the piston 10 will be first to occupy the lower-most position relative to the body of the hydraulic cylinder 8. Thereafter, the index pins 18 are introduced into the holes 17 provided in the thickened portion 12, with the casting 6 being withdrawn by means of the piston 31. As the casting 6 is withdrawn, the mould 1 is concurrently subjected to swinging or reciprocated motion.

After the piston 31 is moved downwards to take the lowermost position relative to the body of the hydraulic cylinder 8, the index pins 18 are withdrawn from the holes 17 fitted in the cylinder, whereupon the working fluid pressure is above the pistons 10 and 31. The flow rate of the working fluid is selected such that the speed of the body of the cylinder 8 travelling downwardly relative to the piston 10 will be precisely two times the casting withdrawal speed, and the travelling speed of the piston 31 relative to the body of the hydraulic cylinder 8 will be equal to the casting withdrawal speed. The difference in speeds at which the body of the hydraulic cylinder 8 and the piston 31 travel, equal to the casting withdrawal speed, allows the casting to be withdrawn in the downward direction at a requisite speed.

The pistons 10 and 31 are found at the same time in the upper-most position relative to the body of the hydraulic cylinder 8. The index pins 18 are then introduded into the holes 17 in the body of the hydraulic cylinder 8, while other index pins 18 are withdrawn from respective holes 17 provided in the dummy bar thickened portion, with the working fluid pressure being above the pistons 10 and 31. In this sequential order operate the structural elements of the semicontinuous-casting apparatus, thus effecting the casting withdrawal.

The removal of the castings from the casting apparatus of the invention is effected in accordance with one of the examples given in the description of the embodiment of the invention illustrated in FIG. 1.

The construction of the semicontinuous-casting apparatus shown in FIG. 2 permits, as compared to the apparatus shown in FIG. 1, the idle downward movement of the body of the hydraulic cylinder 8 to be dispensed with, thereby enhancing the apparatus production capacity and increasing it to a level close to that of the continuous casting process.

While particular embodiments of the invention have been shown and described, various modifications thereof will be apparent to those skilled in the art and, therefore, it is not intended that the invention be limited to the disclosed embodiments or to the details thereof and departures may be made therefrom within the spirit and scope of the invention as defined in the claims.

What is claimed is:

1. An apparatus for semicontinuous casting of metal comprising stationary mounted legs; a secondary-cooling chamber disposed intermediate said stationary mounted legs; a mould positioned above said secondary-cooling chamber; a dummy bar positioned within said secondary-cooling chamber and having a thickened portion and a body, the body of said dummy bar including a hydraulic cylinder to withdraw a casting from said mould and mounted to move lengthwise of said secondary-cooling chamber, said hydraulic cylinder having a first chamber which accommodates a first piston and rod assembly formed with said thickened portion and including an additional chamber arranged lengthwise of said secondary-cooling chamber and accommodating a second postion and rod assembly, the second piston stroke thereof being two times less than that of the first piston stroke; and index pins longitudinally movable by means of actuators, secured on said stationary mounted legs and extending through openings in walls of said secondary-cooling chamber and cooperating with holes fitted in lateral sides of the thickened portion and the body of said dummy bar.

* * * * *